United States Patent [19]

Klygis et al.

[11] Patent Number: 4,807,751

[45] Date of Patent: Feb. 28, 1989

[54] PACKAGE FOR CONTAINERS

[75] Inventors: Mindaugas J. Klygis, Barrington; William N. Weaver, Northbrook, both of Ill.

[73] Assignee: Illinois Tool Works Inc., Chicago, Ill.

[21] Appl. No.: 101,174

[22] Filed: Sep. 25, 1987

[51] Int. Cl.[4] ..... B65D 75/00

[52] U.S. Cl. ..... 206/427; 206/155; 206/194; 206/432; 206/497; 206/605; 229/52 BC

[58] Field of Search ..... 206/141, 155, 193, 194, 206/196, 427, 432, 605, 497; 229/40, 52 BC

[56] References Cited

U.S. PATENT DOCUMENTS

| | | | |
|---|---|---|---|
| 2,874,835 | 2/1959 | Poupitch | 206/193 |
| 3,403,779 | 10/1968 | Becker et al. | 229/40 |
| 3,570,663 | 3/1971 | Cunningham | 206/197 |
| 3,670,950 | 6/1972 | Rossi | 206/155 |
| 3,700,275 | 10/1972 | Deasy | 206/196 |
| 3,837,478 | 9/1974 | Cunningham | 206/427 |
| 4,022,372 | 5/1977 | Graser | 229/40 |
| 4,378,879 | 4/1983 | Killy | 206/427 |
| 4,386,698 | 6/1983 | Klygis | 206/432 |
| 4,637,515 | 1/1987 | Wilson et al. | 206/427 |

*Primary Examiner*—David T. Fidei
*Attorney, Agent, or Firm*—T. W. Buckman

[57] ABSTRACT

A unitary package for retaining and handling a plurality of generally elongate containers arranged in array includes an arranging structure in which an apertured sheet of resiliently deformable material has a plurality of apertures within which respective lower end portions of the containers are gripped in mutually spaced apart relationship. A film envelope is stretched over the container array and bonded to the sheet of the arranging structure to provide tensioned cohension between the sheet and the envelope which cooperate to produce structural integrity of the package and handling as a stabilized unit without relative skewing of the containers.

20 Claims, 3 Drawing Sheets

PACKAGE FOR CONTAINERS

BACKGROUND OF THE INVENTION

This invention relates to packaging for retaining and handling a plurality of containers or the like, and more particularly relates to structure of a unitary package for an array of containers such as beverage bottles.

Development of packages for multiple containers such as cans and glass bottles for food and beverage products to be conveniently handled by consumers has generally required devices for spacing the containers, for example the particularly effective webbed and apertured plastic sheet carrier described in U.S. Pat. No. 2,874,835. Further effort to improve the unity of consumer-handled packaging for multiple glass bottles has led to proposals for wrap-around, stretchable film packaging such as that described in U.S. Pat. No. 3,837,478, which have not provided for adequate bottle protection. As a result, alternatives to wrap-around film such as foldable, rigid sheet separator devices such as that described in U.S. Pat. No. 3,700,275 have been proposed for firmly supporting and separating packaged bottles.

An object of the present invention is to provide novel packaging particularly suitable for bottles which gives the user a confident "feel" of handling an integral or unitary object.

Another object of the invention is to provide a novel package of the above-described type for bottles and the like from which the bottle can be easily removed by a consumer.

Still another object of the present invention is to provide a novel package of the above-described type capable of protecting the bottle from injury and the contents of the bottle from adverse effects of light and further providing broad surfaces for presenting label design or advertising messages.

Other objects and advantages of the invention will become apparent from the following description.

SUMMARY OF THE INVENTION

The unitary package of this invention provides for retaining and handling a plurality of generally elongate containers arranged in array, and includes an arranging structure comprising an apertured sheet of resiliently deformable material having a plurality of apertures within which respective lower end portions of the containers are gripped in mutually spaced apart relationship, and a film envelope stretched over the container array; the envelope is tensioned and secured to the sheet of the arranging structure to provide stabilizing cohesion between the sheet and the envelope which cooperate to produce structural integrity of the package and handling as a stabilized unit without relative skewing of the containers.

The film envelope includes an upper panel having holes through which upper portions of the respective containers project and are peripherally gripped. A skirt portion of the envelope extends downwardly from the holes and overlaps the arranging structure sheet to which it is secured. The skirt portion terminates below the sheet to provide a lower opening of the skirt adjacent the lower end portions of the containers.

The skirt portion also includes an upper pair of closure flaps and a lower pair of closure flaps which provide a tensioned closure portion of the skirt and envelope. The upper flaps and lower flaps are separately joined to allow the skirt to conform to different respective upper and lower exterior contours of the containers and different container styles without creating excessive puckering in tensioning the envelope. Tear strips can be provided on the closure flaps and the tear strips can be arranged to remain attached to the envelope when torn to open the closure.

The holes in the upper panel of the envelope have dissimilar diameters so that registry of the holes with the respective container ends.

In a preferred embodiment, the film envelope is fabricated from an integral sheet or blank which can be printed to provide both advertisement and a light barrier for particular protection of bottled beer.

DESCRIPTION OF THE PREFERRED EMBODIMENT

Figure 1:
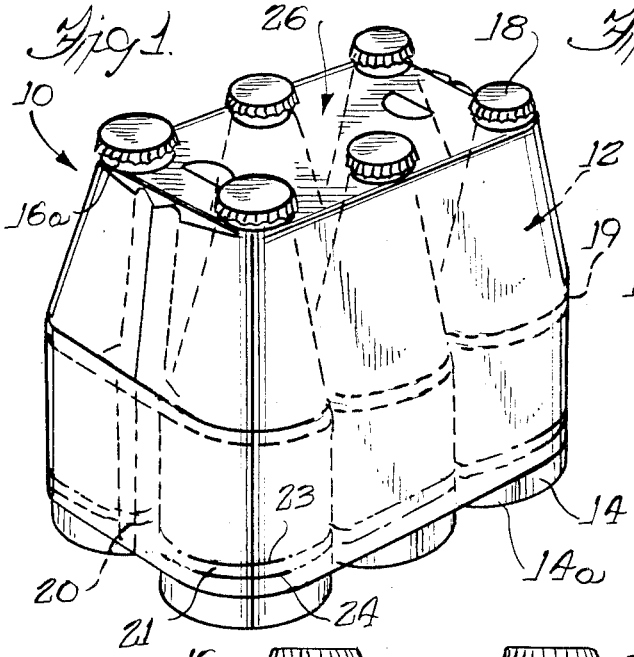
FIG. 1 is a perspective view of one embodiment of the container package of the invention, illustrating packaging of a typical arrangement of six bottles.

Referring to FIGS. 1–4, an embodiment of the container package generally designated by reference character 10 is assembled to secure six typical beer bottles 12, each having a generally cylindrical sidewall 14 and a reduced neck portion 16 having a conventional enlarged bead **16*a* adjacent the mouth at upper end which is closed by a cap 18. Similar generally elongate containers such as jars and cans can also be conveniently retained and handled with suitable modifications to the package 10. Preferably, the bottles 12 or other containers are arranged in a rectilinear array of ranks and rows which are maintained by the package 10 to prevent skewing, shifting or other movement of the individual bottles with sufficient impact to allow glass breakage or scratching, and the package 10** enables convenient handling of the retained bottle arrangement in a unitary assembly.

Figure 4:
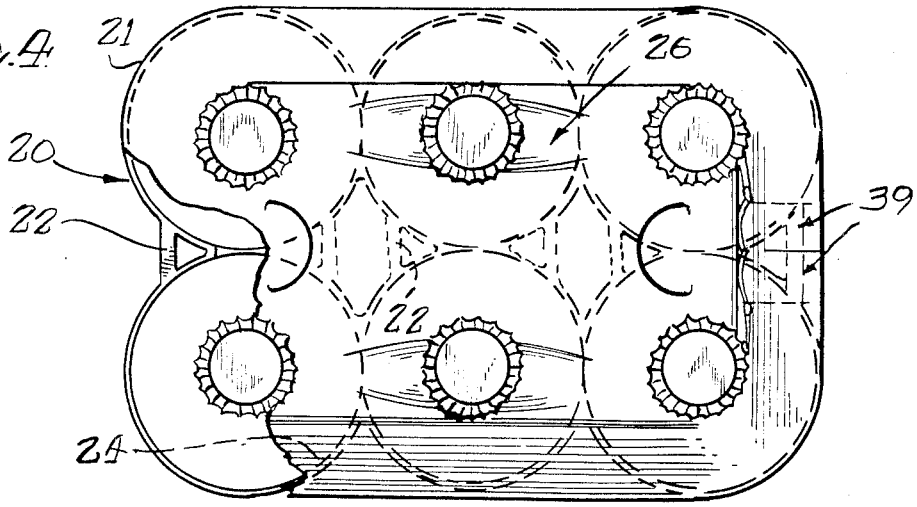
FIG. 4 is a top plan view of the package shown in FIG. 1, partially broken away to illustrate the webbed arranging device in both solid and hidden lines.

Package 10 includes a typical arranging structure 20 fabricated as a sheet of resilient, elastic and deformable material such as plastic in which a plurality of apertures are integrally connected as more fully described for example in U.S. Pat. No. 2,874,835, and numerous commercial improvements thereof marketed by Illinois Tool Works, Inc. under the trademark Hi-Cone. As best shown in FIG. 4, the arranging structure 20 provides moderately rigid, webbed interconnections 22 of apertures 24 through which the lower ends 14*a* of the bottle walls 14 project and are retained in secure separation by the webs 22 while the package 10 is maintained as a unit. Conventionally, the glass bottles can have a circumferential step 19 or an enlarged bead on the upper sidewall 14 which provides for integrally reinforced bottle engagement thereat which can be maintained to prevent breakage.

The package 10 further includes a film or sheet of envelope material 26, preferably plastic such as 2–4 mil polyethylene. The film 26 is tightly stretched around the bottle arrangement by automatic equipment, subsequent to insertion of the lower ends 14*a* of the bottles 12 through the apertures 24 of the arranging structure 20, so that the film 26 extends downwardly to overlap the arranging structure 20. As shown in FIG. 1, preferably, the overlapped, arcuate corners 21 of the film 26 and device 20 are bonded, such as by heat sealing or suitable adhesive, in order to prevent elevated slipping or peeling of the film 26 as well as further promoting integral cohesion of the film 26, arranging structure 20 and package 10 generally. In addition the film is stretched over and conforms to the arranging structure so as to provide interlocking shoulders indicated at 23 and 25 in FIGS. 2 and 3 further to mechanically secure the film and arranging structure with respect to each other. Preferably, the lower bottle ends 14*a* project below the bottom edge of the film 26 so that the film provides a generally five-sided envelope around the bottles 12 but is open at the bottom end allowing access to the packaged bottles for cooling medium. The enveloping nature of the five-sided package serves to minimize the possibility of flying glass fragments in the event one or more of the bottles breaks while in the package.

Figure 5:
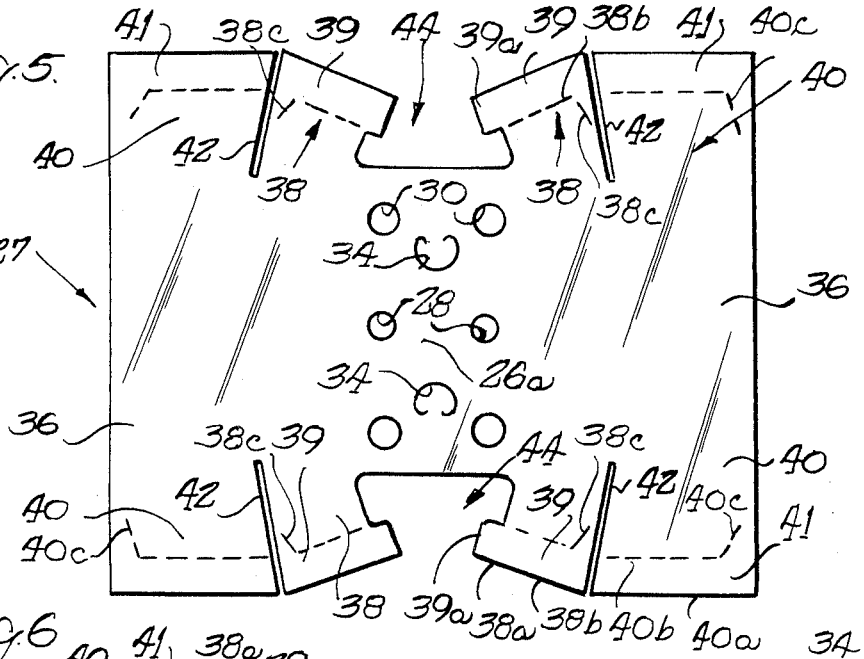
FIG. 5 is a top plan view of a film blank which can be folded to form an envelope stretched over the bottles in the package shown in FIG. 1.

Referring again to FIG. 1, the film 26 is provided with six (bottle) holes through which the six bottle necks 16 respectively project upwardly. As shown in FIG. 5, illustrating the unfolded blank 27 from which the film envelope 26 can be erected, the two central film holes 28 preferably have a smaller diameter than the diameter of the four lateral film holes 30.

Preferably, the holes 28 are smaller than the neck portions 16 of the bottles 12 so that the periphery of the holes 28 is turned up and slightly stretched to tightly engage the bottle necks 16 beneath the enlarged beads 16*a* of the two central bottles 12 when inserted in generally precise registry by automatic stretching equipment. Since holes 30 are adjacent free extremities of the upper panel 26*a*, they cannot be reliably registered in an "interference" fit with the respective bottles, and therefor, the holes 30 are slightly larger than holes 28.

Figure 11:
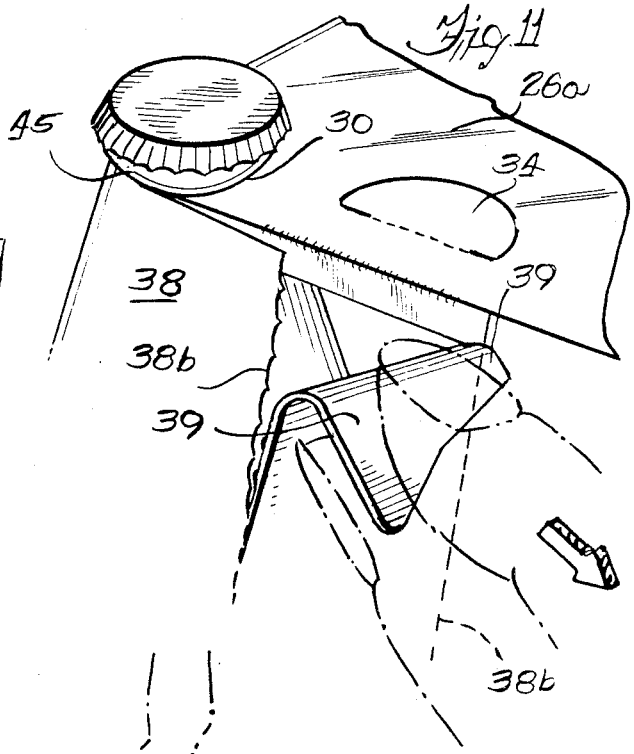
FIG. 11 is a fragmentary perspective view illustrating the initial tearing of the tear strips shown in FIG. 10.
Figure 12:
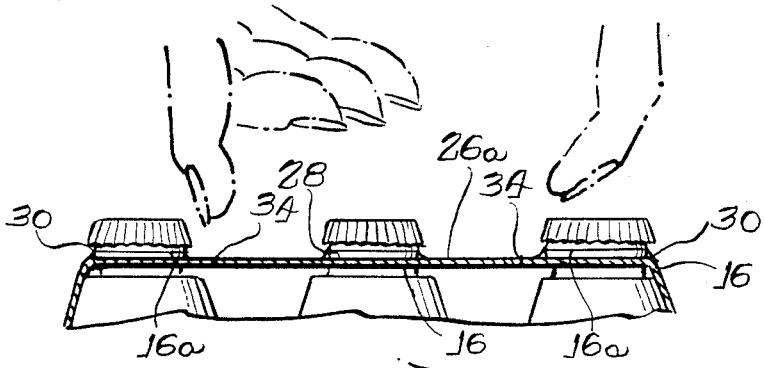
FIG. 12 is a sectional view similar to the side view of FIG. 3, illustrating the tension in the upper panel of the film envelope which grips the neck portions of the packaged bottles.
Figure 13:
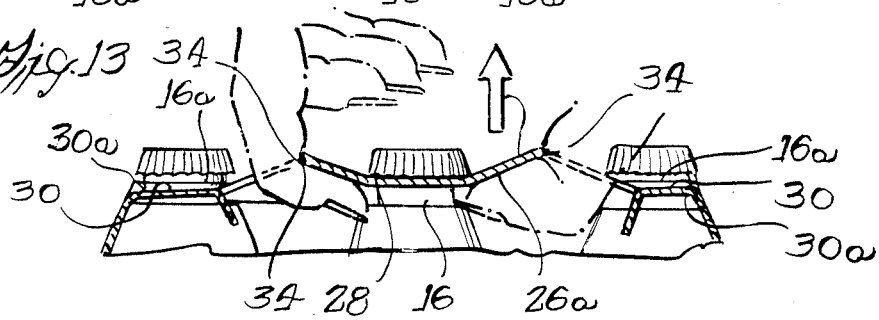
FIG. 13 is a sectional view similar to FIG. 12, illustrating the insertion of a handler's fingers through finger holes in the slightly displaced upper film panel, for carrying the package.

As particularly illustrated in FIG. 13, the very tight engagement of the periphery of the holes 28 with the respective bottle necks 16 permits only limited upward displacement of the central film portion 26*a* when gripped by the fingers of the package handler which are inserted through the opposing pair of finger holes 34 provided between the hole pairs 30, 30. As a result of this small upward displacement of film portion 26*a*, anchored by the tightly engaged periphery of the holes 28, the periphery of the four lateral holes 30 is tensioned inwardly producing tighter grip of the respective bottle necks 16 and engagement under the respective beads 16*a*, particularly by the outwardly lateral peripheral portions 30*a*, promoting a tactile sensation of unitary stability of the package 10 in the handler's fingers. As illustrated in FIG. 11 the finger holes 34 can be provided by die cut or scored flaps 34*a* which remain integrally hinged to the film portion 26*a* so that advertisement can be displayed thereon without interruption until handling access to the holes 3 is needed and the flaps are then folded inwardly.

Figure 2:
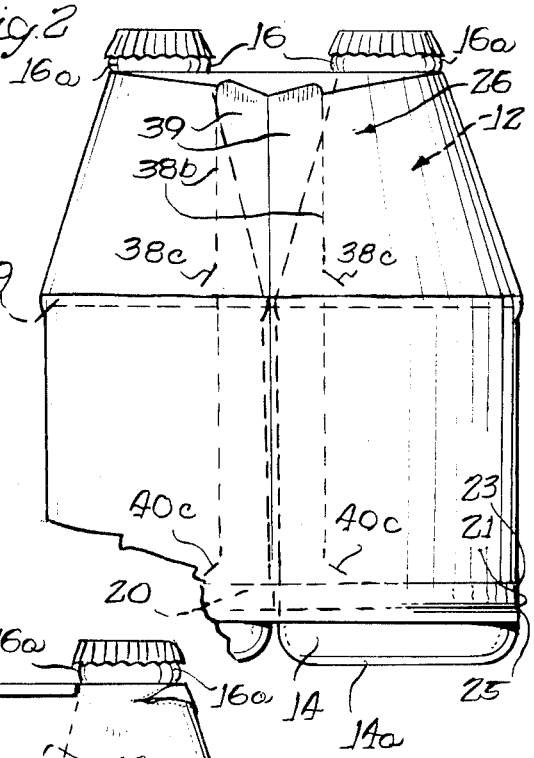
FIG. 2 is an end view of the package shown in FIG. 1.
Figure 3:
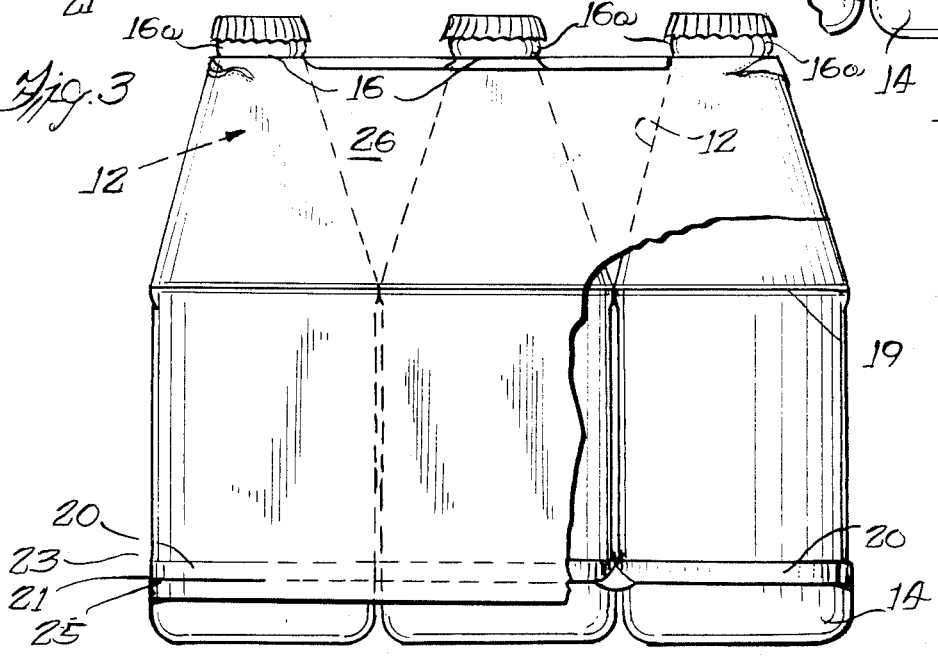
FIG. 3 is a side view of the package shown in FIG. 1.
Figure 8:
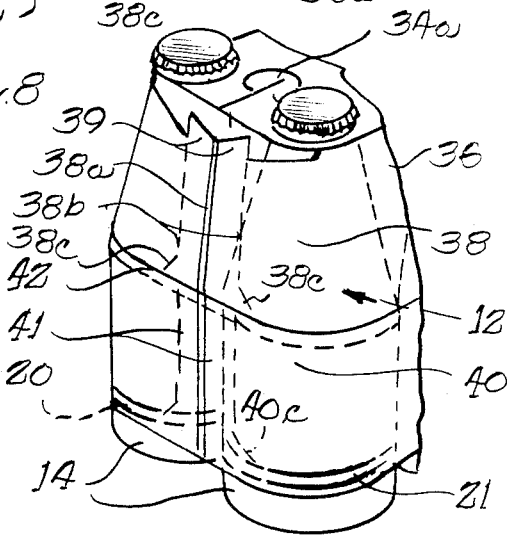
FIG. 8 is a fragmentary, perspective end view of the package similar to FIG. 2.

Referring again to FIG. 5, the generally rectangular, unfolded film blank 27 can be die cut from an intermittently moved web of film in the conventional manner, using a die of suitable configuration. A printing operation can be performed on the film web before or after cutting and folding the blank 27. Die cutting the blank 27 produces two pair of opposing end flaps 38, 40; the four lower end flaps 40 are located at the corners of the rectangular blank 27 and are separated from the respectively adjacent, upper end flaps 38 by cut lines 42 which extend to the adjoining, peripheral edges 38*a* and 40*a*, respectively. As shown in FIGS. 2 and 8, the end flap pairs 38 and 40 are partitioned by the cut lines 42 to enable the upper end flaps 38 to closely conform to the upper body contour and various bottle styles, particularly the illustrated bottle taper, independently of the conformation by the lower flaps 40 to the lower bottle contour. In addition, the upper, peripheral flap edges 38*a* are inwardly inclined in relation to flap edges 40*a* in order to closely conform to the upper bottle taper and prevent puckering of the upper portion of the film envelope 26.

Figure 6:
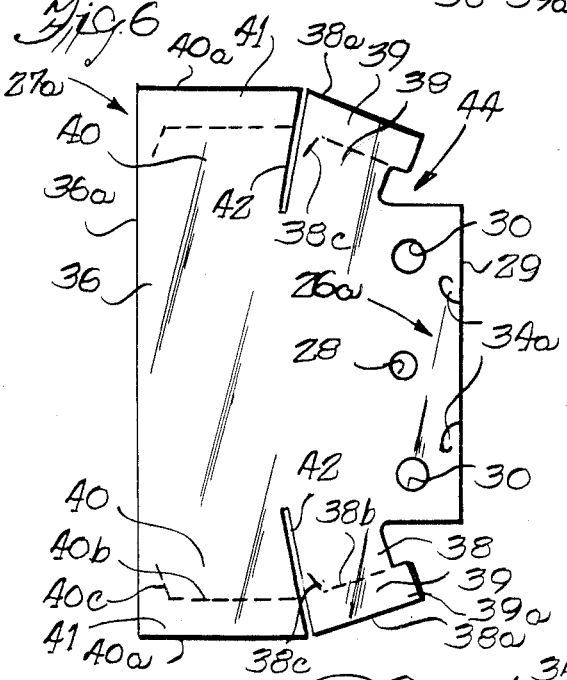
FIG. 6 is a top plan view of a flattened envelope which is expanded and then stretched to form the package shown in FIG. 1.

The unfolded blank 27 has a generally rectangular, symmetrical configuration which allows bi-folding to form a fold line 29 and folded-blank 27*a* which are illustrated in FIG. 6. The fold line 29 also bisects the finger holes 34 so that folding the blank 27 produces the congruently overlapped blank 27*a*.

After folding the blank 27 to form the folded-blank 27*a*, the congruently overlapped, peripheral flap edges 38*a* and 40*a* are then bonded, preferably by heat sealing, to form the joined tear strip pairs 39, 39 and 41, 41. The folded-blank 27*a*, with heat sealed edges 38*a*, 40*a* is a flattened envelope, as illustrated in FIG. 6, which is conveniently stored, transported, and supplied to the container packagers.

Alternatively, the flattened envelope of blank 27*a* in FIG. 6 can be fabricated from a blown film tube in lay-flat configuration in which the fold line 29 forms one folded edge of the lay-flat tube and the opposite edge of the tube is slit to form the free, superimposed edges 36*a* of the two overlapped panels 36. The superimposed holes, perf and cut lines can be die cut in the tube, followed by heat sealing together the cut edges 38*a* and 40*a*. Both surfaces of the blank 27*a* can be printed either before or after the cutting and sealing.

Figure 9:
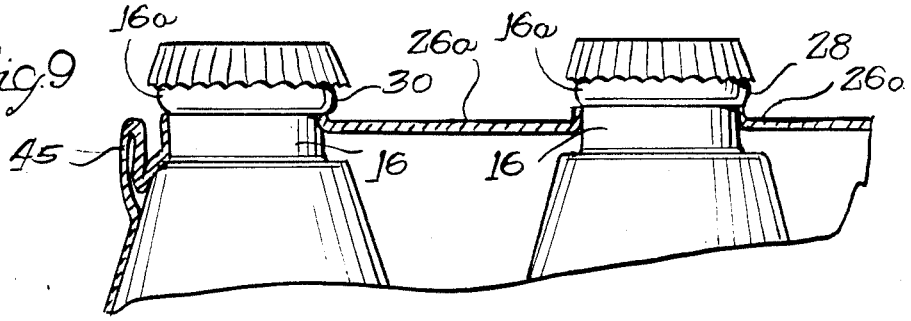
FIG. 9 is a sectional view of the upper panel and hole periphery in the package of FIG. 1.
Figure 10:
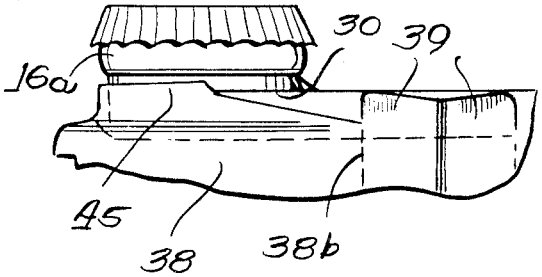
FIG. 10 is a fragmentary end elevation view illustrating the tear strips shown in FIG. 8.

Each of the flaps 38 and 40 includes a respective "perf" line 38*b*, 40*b* generally parallel to and spaced inwardly from the respective peripheral edge 38*a* 40*a* in order to provide respective tear strips 39, 41 therebetween. In the film blank 27, the adjacent upper end flaps 38 within each pair are separated by a respective cutout 44 which extends inwardly toward the holes 30, and defines the upper periphery of the tear strips 39. The cutouts 44 reduce the amount of overlap 45 created in the upper portion of the flaps 38 in the envelope package as shown in FIGS. 9–11.

Figure 7:
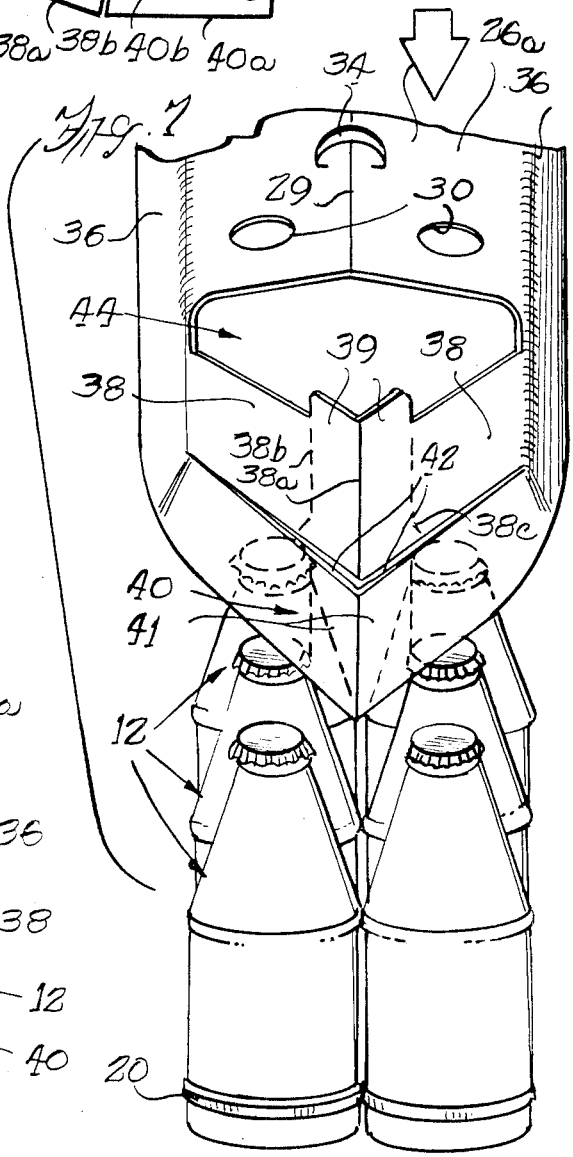
FIG. 7 is a fragmentary, perspective view of the operation in which the flattened envelope is expanded and stretched over the arranged bottles to form the package shown in FIG. 1.

In order to fully erect the container package 10, after inserting the lower ends 14*a* of the bottles 12 through the apertures 24 of the arranging structure 20, the folded blank 27*a* is expanded to form the open-bottomed, generally five-sided film envelope 26 which is stretched over the structured bottle arrangement as illustrated in FIG. 7. After pulling the expanded film envelope 26 downwardly over the bottles until the bottle necks 16 are gripped within the respective holes 28, 30, the envelope creates a tightly stretched sleeve around the array of bottles. Thereafter, the arcuately stretched corners 21 of the respective lower film flaps 40 are secured to the overlapped corners of the arranging structure 20 to maintain the film tension and the cohesion of the package 10, as previously described. The illustrated configuration of the packaged bottle arrangement positions the end flaps 38, 40 at the opposing ends of the package 10 with respect to the film sides 36, as illustrated in FIG. 8.

As best shown in FIGS. 5 and 6, the perf lines 38*b* and 40*b* do not extend to the lower flap edges (e.g., 42) and the joined, heat-sealed tear strips 39, 39 (and 41, 41) are jointly torn downwardly by the envelope 26 as illustrated in FIG. 11. The perf lines 38*b* and 40*b* can terminate in end portions 38*c* and 40*c* which are angled in opposite directions so that only one of the joined tear strips will normally be torn from its respective, originally connected flap, and each tear strip pair will normally remain connected to the other respective flap 38 or 40 by a small, untorn web, thus preventing entirely detached tear strips and potential litter. In addition, the removed film envelope 26 can normally remain bonded, preferably at the corners 21, to the arranging structure 20 so that even the package 10 removed from all of the bottles 12 is maintained in unitary condition for convenient disposal. Preferably the tear strips 39 include upper end tab portions 39*a*. After removing the film envelope 26 from a bottle 12, the user can grasp the bottle and easily apply sufficient pivotal leverage upon the periphery of the arranging structure aperture 24 adjacent the lower end of the bottle sidewall 14 to pull and remove the bottle from the aperture.

When the film envelope 26 is fully applied, the force of the circumferential tension urges and holds upper ends 19 of the bottle bodies in aggressive contact with each of the immediately adjacent bottles both longitudinally and transversely of the package. This action in combination with the arranging structure 20 which positively maintains the bottles in their respective ranks and rows and prevents any skewing of the array, gives the package the "feel" of a solid or unitary object which will enable a user to carry the package with confidence.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A unitary package for retaining and handling a plurality of arranged containers or the like, comprising: a plurality of generally elongate glass bottle containers arranged in an array; an arranging structure comprising a discrete apertured sheet of resiliently deformable material having a plurality of apertures within which respective body portions of the containers are gripped; a discrete film envelope stretched over said container array and comprising an upper panel having a plurality of holes through which upper portions of said respective containers project, said envelope further comprising a four sided skirt portion downwardly extending from said holes and being overlapped and bonded to said sheet to provide cohesion therebetween, thereby providing a tightly compressed resilient unitary package.

2. A unitary package for retaining and handling a plurality of arranged containers or the like, comprising: a plurality of generally elongate containers arranged in an array; an arranging structure comprising a discrete apertured sheet of resiliently deformable material having a plurality of apertures within which respective body portions of the containers are gripped; a discrete film envelope stretched over said container array and comprising an upper panel having a plurality of holes through which upper portions of said respective containers project, said envelope further comprising a four sided skirt portion downwardly extending from said holes and being overlapped and bonded to said sheet to provide a cohesion therebetween, wherein said skirt portion comprises a first, upper pair of closure flaps and a second, lower pair of closure flaps located below said first pair of flaps, said flaps within each of said pairs being oppositely joined, said joined pairs being adjacently located to provide a tensioned closure portion of said skirt portion.

3. The package according to claim 2 wherein one of said upper flaps and a respective one of said lower flaps are adjacently separable by a margin line enabling said joined, upper flap pair and said joined lower flap pair to engagingly conform to different respective exterior contours formed on said containers.

4. The package according to claim 3 wherein each of said margin lines is defined by a cut line through said skirt portion 5. The package according to claim 2 wherein said upper and lower joined flap pairs are provided on each of two opposing closure ends formed on said skirt portion.

6. The package according to claim 2 wherein at least one of said upper flaps includes a tear strip for opening said closure portion.

7. The package according to claim 2 wherein each of said upper flaps includes a respective tear strip, said tear strips being joined to enable joint tearing thereof for opening said closure portion.

8. The package according to claim 7 wherein each of said tear strips is defined by a score line spaced from said margin line in order to prevent at least one of said tear strips from being entirely separated from said respective integral flap during said opening.

9. The package according to claim 7 wherein each of said lower flaps includes a respective tear strip, said tear strips being joined for joint tearing to open said closure portion.

10. The package according to claim 9 wherein each of said lower flap tear strips is partially defined by a score line spaced above a free edge defining said skirt portion termination, in order to prevent at least one of said lower flap tear strips from being entirely separated from said respective integral flap.

11. The package according to claim 1 wherein said containers are arranged in a rectilinear array, and wherein said bonding of said skirt portion and apertured sheet is located at four positions in a plane generally perpendicular to axis of containers, adjacently engaged with the containers forming the corners of said rectilinear array, in order to promote balance of the stabilizing cohesion resulting from said bonding.

12. An integral blank of film for stretched enclosure of an arrangement of containers to provide a tensioned, packaging envelope thereon, comprising a centrally located top panel having a plurality of holes for projection of container ends therethrough in the stretched envelope; a pair of side panels extending oppositely from said central panel for forming opposing sides of said envelope; each of said side panels having respective partitioned ends thereof to define at least two adjacently separable flaps formed on both ends of each respective side panel, said four flaps on each side panel being arranged in an aligned row for forming a pair of opposing end panels, each including a first opposing end flap pair positioned above a second opposing end flap pair in the stretched envelope.

13. The blank according to claim 12 wherein at least one of said partitioned ends includes one of the flaps of said first flap pair and a respective one of the flaps of said second flap pair adjacently separated by a cut line.

14. The blank according to claim 13 wherein each of said flaps includes a tear strip partially defined by a score line.

15. The blank according to claim 14 wherein each of said tear strips is further defined between said score line and a respective free, peripheral edge formed on said flap.

16. The blank according to claim 14 wherein said score lines of said first flap pair are separated from said cut line and terminate in portions extending generally in opposite directions.

17. The blank according to claim 12 wherein two of said respective end flaps are adjacent said central panel on respective side panels and opposingly separated by a cut-out formed in the blank.

18. A unitary package for retaining and handling a plurality of generally elongate containers arranged in an array, comprising a film envelope for stretching over said container array and comprising an upper panel having a plurality including a pair of holes having smaller diameters located between two pairs of larger diameter holes, the smaller diameter holes tightly gripping the complete periphery of the associated neck portions of containers projecting therethrough, said envelope further comprising a skirt portion downwardly extending from said holes and tensioned for supportive engagement with said containers to maintain said array.

19. The package according to claim 18 wherein said skirt portion further comprises a first, upper pair of closure flaps and a second, lower pair of closure flaps located below said first pair of flaps, said flaps within each of said pairs being oppositely joined, said joined pairs being adjacently located to provide a tensioned, closure portion of said skirt portion, wherein one of said upper flaps and a respective one of said lower flaps are adjacently separable by a margin line for enabling said joined, upper flap pair and said joined lower flap pair to engagingly conform to different respective exterior contours formed on said containers.

20. The package according to claim 19 wherein each of said upper flaps includes a respective tear strip, said tear strips being joined to enable joint tearing thereof for opening said closure portion and wherein each of said tear strips is defined by a score line spaced from said margin line in order to prevent at least one of said tear strips from being entirely separated from said respective integral flap during said opening.

* * * * *